US006116517A

United States Patent [19]

Heinzl et al.

[11] Patent Number: 6,116,517

[45] Date of Patent: Sep. 12, 2000

[54] DROPLET MIST GENERATOR

[75] Inventors: Joachim Heinzl; Ingo Ederer, both of München; Josef Grasegger, Garmisch-Partenkirchen; Wolfgang Schullerus, Bad Feilnbach; Carsten Tille, München, all of Germany

[73] Assignee: Joachim Heinzl, Munich, Germany

[21] Appl. No.: 09/214,361

[22] PCT Filed: Jun. 24, 1997

[86] PCT No.: PCT/DE97/01307

§ 371 Date: May 11, 1999

§ 102(e) Date: May 11, 1999

[87] PCT Pub. No.: WO98/00237

PCT Pub. Date: Jan. 8, 1998

[30] Foreign Application Priority Data

Jul. 1, 1996 [DE] Germany ..... 196 26 428

[51] Int. Cl.[7] ..... B05B 1/08

[52] U.S. Cl. ..... 239/101; 417/410.2

[58] Field of Search ..... 417/410.2; 239/99, 239/101, 102.2

[56] References Cited

U.S. PATENT DOCUMENTS

| | | | |
|---|---|---|---|
| 3,211,088 | 10/1965 | Naiman | 239/102.2 X |
| 3,900,162 | 8/1975 | Titus et al. | 239/102.2 |
| 4,245,225 | 1/1981 | Fillmore et al. | 239/102.2 X |

FOREIGN PATENT DOCUMENTS

| | | | |
|---|---|---|---|
| 0337429A | 10/1989 | European Pat. Off. . | |
| 0427291A | 5/1991 | European Pat. Off. . | |
| 0516188A | 10/1992 | European Pat. Off. . | |
| 0612621 | 8/1994 | European Pat. Off. . | |
| 634273A2 | 1/1995 | European Pat. Off. . | |
| 713773A2 | 5/1996 | European Pat. Off. . | |
| 2912620A | 10/1979 | Germany . | |
| 3306101A | 8/1984 | Germany . | |
| 3317082A | 11/1984 | Germany . | |
| 3705980 | 9/1988 | Germany | 239/102.2 |
| 19507978A1 | 9/1996 | Germany . | |
| 61-03357A | 6/1986 | Japan . | |
| 1-18643 | 1/1989 | Japan . | |
| 01105746A | 7/1989 | Japan . | |
| 3-7348A | 1/1991 | Japan . | |
| 03216344A | 12/1991 | Japan . | |

OTHER PUBLICATIONS

Siemens, Piezoelektrische Biegewandler, Oct. 1984.

*Primary Examiner*—Kevin Weldon
*Attorney, Agent, or Firm*—J.C. Patents; Jiawei Huang

[57] ABSTRACT

In a pump chamber connected to a liquid supply, an overlapping piezoelectric flexural transducer is disposed so that when voltage pulses are applied to produce an excursion, a number of droplets can be expelled from a nozzle array in the housing wall of the pump chamber using a plurality of nozzles. Gaps are formed between the edges lateral to the direction of overhang an the free end of the piezoelectric flexural transducer ad adjacent section of the housing wall. The nozzle array can be disposed in the projection of the plate surface of the piezoelectric flexural transducer in its direction of motion or in the extension of the piezoelectric flexural element or in another suitable pattern. As part of a combustion device the droplet mist generator is excellent for producing a combustible fuel-oxidant mixture.

16 Claims, 10 Drawing Sheets

DROPLET MIST GENERATOR

This application is a 35 U.S.C. 371 of application number PCT/DE97/010307 filed Jun. 24, 1997.

BACKGROUND OF THE INVENTION

1. Field of Invention

The invention concerns a droplet mist generator and, in particular, a droplet mist generator as apart of a burner.

2. Summary of the Invention

Micro-droplet mist generators for producing individual droplets on call are known in ink printing. In EP-O 713 773 a droplet mist generator with piezoelectric flexural transducers and a nozzle each under the transducer is proposed in which the individual transducers with partition walls are separated from each other so that when the transducer is deflected from the true path, a droplet is ejected from the nozzle assigned to another transducer.

From the older German patent application with the file number 19507978.7 a dosing system for fuel dosing is known that has numerous micro-nozzles and electrothermic, electrostatic, electrodynamic, or piezoelectric transducers with which an expansion of vapor bubbles in a fuel-filled chamber or a change in volume of this chamber is effected by means of an electrical trigger signal, therefore making it suitable for the repeated ejection of fuel droplets that are essentially of the same size. The use of a piezoelectric membrane actuator is described as a preferred transducer principle.

When using the expansion of vapor bubbles as an actuator principle for dosing traditional types of fuel, the various components of the fuel vaporize under very different conditions. The vaporization therefore does not occur abruptly enough to achieve an efficient formation of droplets. Variations in the composition of the fuel lead, in addition, to irregularities so that reliable dosing or transport is not possible when using the vapor bubbles principle. Transducers in which the chamber volume is changed are complicated structures. In the case of a piezoelectric flexural transducer, for example, a piezoelectric ceramic element is covered with a membrane that forms a chamber wall. This is necessary to obtain the change in volume, because when a piezoelectric crystal expands in a direction, there is always a vertical contraction connected with it. In the piezoelectric flexural transducer and the membrane, material must be deformed during a large-scale deflection from the true path so that works of deformation must be carried out against strong inner mechanical resistance. Such transducers therefore work with a poor degree of effectiveness. And in relation to the structural size of the transducer elements, only a small dispersion is attained due to the resistance. A high acceleration of fluid also cannot be obtained.

By using the invention, the problem of creating an inexpensive pump with a small structural size in which a stream of fluid in the form of a cloud of droplets can be dosed with a high flow rate while maintaining a certain droplet size and density is solved.

The problem is solved according to the invention by a droplet mist generator. The droplet mist generator comprises a pump chamber, which is constructed in a casing and is connected to a fluid reservoir; a nozzle area constructed in the casing wall, having a plurality of nozzles; a plate-shaped piezoelectric flexural transducer that is positioned in the pump chamber and attached so that it overhangs and can be bent around a quadrature axis running transversely to the direction of the overhang; openings that are constructed between the edges of the piezoelectric flexural transducer, which form ends in the direction of its quadrature axis, and the casing wall; and a control system through which voltage impulses can be applied to the piezoelectric flexural transducer by bending the piezoelectric flexural transducer, driving out fluids, and ejecting droplets from the nozzles of the nozzle area.

With the idea of impacting an entire area of nozzles with a piezoelectric flexural transducer positioned so it is effectively fluidic inside a chamber filled with fluid, a droplet mist generator with an especially high flow rate is created, whereby the droplet size and density can be determined with the form of the nozzle area and by means of the length, strength, and frequency of the pulse emitted by the control system.

Piezoelectric flexural transducers produce an especially high deflection from the true path when accelerating quickly and can be operated with high frequencies. In addition, they have only a small inner mechanical resistance. Using the piezoelectric flexural transducer principle, a high conversion rate of electrical to mechanical energy can be obtained with respect to the structural size. Moreover, piezoelectric flexural transducers are simple constructions and thus are inexpensive and reliable.

The special arrangement of the transducer and the numerous nozzles leads to the fact that the transformed mechanical energy can be used for the production and transport of the droplet stream with a high degree of efficiency. By transforming the energy directly near the nozzles on which the droplets are formed, a high share of fluidic energy is supplied for the formation of droplets and their transport.

The fluidic losses due to the compression of the fluid are, moreover, minimized because the transformer surface, in front of which a peak pressure is produced during the impacting action, with the nozzle areas faces a large nozzle cross-sectional area, through which a conversion of the produced pressure takes place during transport by forming and ejecting droplets. In other words, a large share of the generated pressure is transformed.

Through the high acceleration of the piezoelectric flexural transducer the entire energy is supplied to the droplets forming on the nozzle in the shortest time span, which leads to an abrupt breaking off of the droplets while preventing a larger back-flow into the chamber.

The opening between the edges of the piezoelectric flexural transducer and the casing wall allows the fluid to stream around the piezoelectric flexural transducer during the backward movement of the piezoelectric flexural transducer so that the increasing volumes between the piezoelectric flexural transducer and the nozzle area are filled with the fluid that is flowing back and no air is pulled into the nozzles in the chamber. The openings are therefore calculated to be so large that fluidic resistance that occurs due to friction remains small enough that the deflection from the true path is not greatly impaired. At the same time, the openings are calculated so they are so small that during the rapid impacting action of the piezoelectric flexural transducer the fluid located in front of the transducer cannot be carried off quickly enough through the opening and is pushed through the nozzles.

The voltage pulses given off by the control system are coordinated in such a way that the transport of fluid is made possible. The impacting action, which causes the ejection of droplets through the nozzle, can occur considerably more quickly than the backward movement of the piezoelectric flexural transducer so that during the impacting action no streaming occurs through the opening in which the backward flow runs against a sufficiently strong stream. For the purposes of the present invention, a known control system can be used.

By using a single piezoelectric flexural transducer to impact several nozzles, the system is inexpensive and not very prone to problems.

According to the invention the chamber and fluid reserve can be connected to any suitable place in the chamber. Preferred, however, is a connecting line on one of the sides of the piezoelectric flexural transducer turned away from the nozzle area. If one does not completely reduce the volume of the chamber, but reduces the volume between the piezoelectric flexural transducer and the nozzles, when the volume on the opposite side is raised, fluid can be drawn from the fluid reserve connected to the pump chamber while the droplets are ejected. In so doing one can obtain especially short repeat times between the successive surges or bending and droplet-ejection operations, as a result of which the transport performance is raised even more.

According to the invention the chamber can be connected to the fluid reserve by means of a line or other connection. Preferably, however, the chamber is connected to the fluid reserve through several lines, especially two lines. In so doing, the droplet mist generator can be degassed during operation by providing fluid through a connecting line and carrying away gas and fluid through the other connection lines. Moreover, an improved and quicker fluid feed can be obtained with a majority of lines, each in a suitable arrangement, which leads to a shortened refill time between two droplet-producing pulses.

According to the invention the connections between the chamber and fluid reserve can be designed so there is as little resistance as possible. Preferred are, however, choke sites in the connections that provide that the least possible fluid is driven through the feed lines that connect the chamber with the fluid reserve, thus guaranteeing that the transport performance of the droplet mist generator is high. Preferably the choke sites are designed in such a way that the fluid goes against a high fluidic resistance during a high pressure impulse when a droplet is ejected, while with a small difference in pressure during the refill operation the fluid goes against only a small fluidic resistance and thus the spray frequency can be increased. Flap valves can also be provided in the connections so that a streaming of fluid into the chamber through the connection is made possible while at the same time preventing the fluid from streaming out.

According to the invention the nozzles can be designed as cylinder-shaped channels, openings, channels with square cross-sectional areas, or channels of any other shape; and they can have a constant channel cross section. They can also be designed so they taper toward the chamber. It is, however, preferable that they are designed so they taper in the direction away from the chamber. In so doing, the cross-sectional area of the nozzle with the smallest diameter is obtained on the opening of the nozzles in the surrounding environment. Because bordering surfaces between two fluids constantly strive to take on the state with the least energy in the smallest area of the boundary surface, a nozzle tapering outward leads to a situation in which the edge of the meniscus between the fluid and gaseous environment constantly strives to remain on the outer edge of the nozzle. By reducing the extent of the change in the position of the meniscus edge, the droplet mist generator is guaranteed to work in an especially robust way, which leads to a higher transport performance because no outfall cycles result.

According to the invention, the outer side of the casing wall in the part of the casing wall in which the nozzle field is positioned can be made of any suitable material. Preferred, however, is a coating with teflon or with another suitable anti-adhesive material. With such a coating one prevents the outer side from being moistened, i.e., a moving forward of the 3-phase boundary between fluid, gaseous surroundings and the casing structure results from opening the nozzle. As a consequence, the meniscus edge remains at the end of the nozzle toward the outside during the formation of the droplets, as a result of which the invention is guaranteed to work in a robust fashion with a high transport performance.

According to the invention the droplet mist generator can have any suitable piezoelectric flexural transducer. Preferably, however, the piezoelectric flexural transducer is a multiple-layer piezoelectric ceramic transducer with an additional passive piezoelectric layer. In so doing, the same deflection of the piezoelectric flexural transducer can be obtained with a small control voltage. This has the advantage that the regulations for the maximum voltage can be observed with many possible uses of the droplet mist generator without limiting the productivity.

According to the invention the droplet mist generator can have only one piezoelectric flexural transducer and only one nozzle area. According to the invention a majority of piezoelectric flexural converters and/or a majority of nozzle areas can be provided in the droplet mist generator. In this connection several piezoelectric flexural transducers are arranged in such a way that their plate surfaces can be positioned in a plane next to one another or their plate surfaces can be positioned in various levels so they overlap each other or are positioned next to each other. In a preferred form of the model an arrangement is provided with a second piezoelectric flexural transducer and a second nozzle area that lie across from the free end of the first piezoelectric flexural transducer and that are essentially mirror-inverted to the first piezoelectric flexural transducer and the first nozzle area. The control system in this case is constructed in such a way that the piezoelectric flexural transducer and the second piezoelectric flexural transducer can be controlled by various pulse frequencies, pulse length, and/or pulse phases. The arrangement of the two piezoelectric flexural transducers lying across from one another with the same control of the piezoelectric flexural transducers leads to a situation in which the fluid, which is driven out to the other piezoelectric flexural transducer, is subject to fluidic resistance due to the incoming fluid forced out of the other piezoelectric flexural transducer. As a result, a higher pressure can build up and the transport flow rate can be increased. By using a control with shifted pulse phase the transport flow rate can be varied. A control can also be carried out with various pulse frequencies and/or pulse lengths. A variation or different control with respect to one or more of the parameters pulse frequency, pulse length, and pulse phase can also be used with a set nozzle arrangement in the nozzle area to vary the droplet size and droplet speed.

According to the invention the nozzle area can be designed in any suitable part of the casing wall. In an especially preferred form the nozzle area is designed in a part of the casing wall that is positioned inside the overhang of the plate surface of the piezoelectric flexural transducer in the direction in which the free end of the piezoelectric flexural transducer is movable when passing through its equilibrium position. The nozzles of the nozzle area are thus essentially positioned in such a way that all the nozzles would be covered by the transducer surface if one would move the piezoelectric flexural transducer up to the part of the casing wall in which the nozzles are constructed. In this working model an opening of a suitable size is designed between the free end of the piezoelectric flexural transducer and the part of the casing wall lying across from it in the extension of the transducer.

According to the invention any suitable distance or no distance at all may separate the piezoelectric flexural transducer from the part of the casing wall in which the nozzle area is designed. In a preferred form of the model when the piezoelectric flexural transducer is in its equilibrium position, a small distance between the piezoelectric flexural transducer and the part of the casing wall in which the nozzle area is designed is formed. In this case the piezoelectric flexural transducer can be moved away from the nozzle area by applying a voltage pulse and then moved back to the nozzle area by applying a reverse polarized voltage or using mechanical restoring forces, whereby the droplet ejection is effected. If the distance is chosen to be small enough, overshooting the equilibrium position when moving it back can lead to a situation in which the piezoelectric flexural transducer hits against the casing wall in which the nozzle area is constructed. The piezoelectric flexural element can, however, be moved away by applying the voltage pulse immediately in the direction toward the nozzle area so that the droplet ejection can be started directly when applying the voltage pulse. In this case as well the piezoelectric element hits against the casing wall. This bumping against the casing wall can have the advantageous effect that the acceleration of fluid is quite abruptly broken off, resulting in an especially regular and quick break off of the droplets. How strong this effect is can depend upon how the piezoelectric flexural transducer and the part of the casing wall in which the nozzle area is constructed are formed. If there are plane surfaces, contact will occur to a great extent across the entire surface; if there are arched surfaces or non-plane surfaces shaped in another form, contact occurs only at one or a few places.

The opening between the free end of the piezoelectric flexural transformer and the casing wall lying opposite it in the extension of the piezoelectric flexural transformer can have any width according to the invention. Preferably, however, it is not more than five times as large as the gap that occurs when the piezoelectric flexural transformer is in equilibrium position when no voltage is applied.

In another preferred form of the model the piezoelectric flexural transformer in its equilibrium position, which occurs when no voltage is applied, lies on the part of the casing wall in which the nozzle area is constructed and the piezoelectric flexural transformer is moved away from the nozzle field by applying voltage by using the control system. In this case the formation of droplets is triggered when the piezoelectric flexural transducer springs back after the voltage pulse ends by applying a reverse voltage impulse or mechanical restoring force.

According to the invention the part of the casing wall in which the nozzle area is constructed can be constructed like the other parts of the casing wall. Preferably the part of the casing wall nonetheless projects into the chamber. Such a form has the advantage that high pressure, which builds up in the gap that becomes more and more narrow as the surface of the piezoelectric flexural transducer is moved to the casing wall, builds up only in the area in which it falls when the droplets emerge from the nozzles and thus can be utilized. As a result, there is a reduction of the fluidic losses during the droplet ejection operation and thus an increase of the transport performance and the efficiency of the pump. An advantageous effect is also obtained when the fluid is refilled from the reservoir. The narrow distance between the piezoelectric flexural transformer and the casing wall, in which fluid can only flow against a high fluidic resistance, is shorter compared to a form of the model without casing wall parts designed to project into the chamber. As a consequence, the necessary fluid can be drawn back more quickly and the droplet production frequency and the transport quantity can be further increased.

In another preferred form of the model the nozzle area is positioned so it lies across from the free end of the piezoelectric flexural transformer in the extension of the piezoelectric flexural transformer. In this way the nozzle area is staggered a little bit with respect to the free end of the piezoelectric flexural transformer. The nozzles are thus, preferably, in the direction of overhang of the piezoelectric flexural transformer. Such an arrangement has the advantage that it is possible, given an especially small construction size, to arrange a majority of the piezoelectric flexural transformers in the direction of the plate surface one after the other or inside the plate surface plane next to each other, whereby each piezoelectric flexural transformer can be assigned to a corresponding nozzle area without having to further enlarge the construction area required to set up the piezoelectric flexural transformer due to the nozzle area. Preferably, in this arrangement when the piezoelectric flexural transformer is in its equilibrium position, there is a gap between the piezoelectric flexural transformer and the next wall lying vertical to the plate surface of the piezoelectric flexural transformer.

According to the invention the droplet mist generator is a droplet mist generator for any suitable fluids. In this connection the droplet mist generator according to the invention can be used separately or as a component of any suitable system. Preferably, the droplet mist generator is nonetheless a component of a burner, whereby the fluid reserve is a fluid fuel reserve. The nozzles of the nozzle area serving as burner nozzles have a smallest diameter of at least 10 $\mu$m and at most 100 $\mu$m. As a result, droplet sizes are obtained that are especially well-suited for the production of an inflammable mixture made of fuel droplets and a gaseous oxidant. With traditional fluid fuels such as diesel fuel or gasoline, such droplet sizes lead to a situation in which the fuel droplets completely evaporate right after the ejection from the nozzle, resulting in an inflammable and/or highly combustible mixture. Depending on the viscosity and transport quantity, the nozzles according to the invention have diameters larger than 100 $\mu$m corresponding to the fluidic requirements.

According to the invention the mid-points of each of the neighboring nozzles of the nozzle area that serve as burner nozzles have any suitable distance between them. Preferably, the mid-points nonetheless occur at intervals of at least 50 $\mu$m and at most 2,000 $\mu$m. By choosing the distances between the neighboring nozzles in this arrangement one obtains a further improvement of the fuel-oxidant mixture, and with it a further increase in the burner performance.

According to the invention the droplet mist generator can have any number of nozzles depending on its use. Preferably, however, the droplet mist generator has at least 50 nozzles. With at least 50 nozzles or more a burner is especially well suited for use as a burner for vehicle heating or household heating devices.

In another preferred form of the model holes are provided in the piezoelectric flexural transducer according to the invention to reduce the fluidic resistance of the piezoelectric flexural transducer. In yet other forms of the model valves according to the invention can be provided in the droplet mist generator with which the transport of fluid is possible even with larger nozzle diameters. In this connection the invention provides that either droplets or a continuous stream of fluid is transported. Preferably, the operation of existing valves is carried out with a piezoelectric flexural transducer that simultaneously converts the fluidic energy. According to the invention the chamber on the nozzles can also be sealed off against its surroundings by bringing the piezoelectric flexural transducer into a certain position.

BRIEF DESCRIPTION OF THE DRAWINGS

Advantageous forms of the invention are described in connection with the drawing. The following are shown in the drawings.

DETAILED DESCRIPTION OF THE INVENTION

Figure 1A:
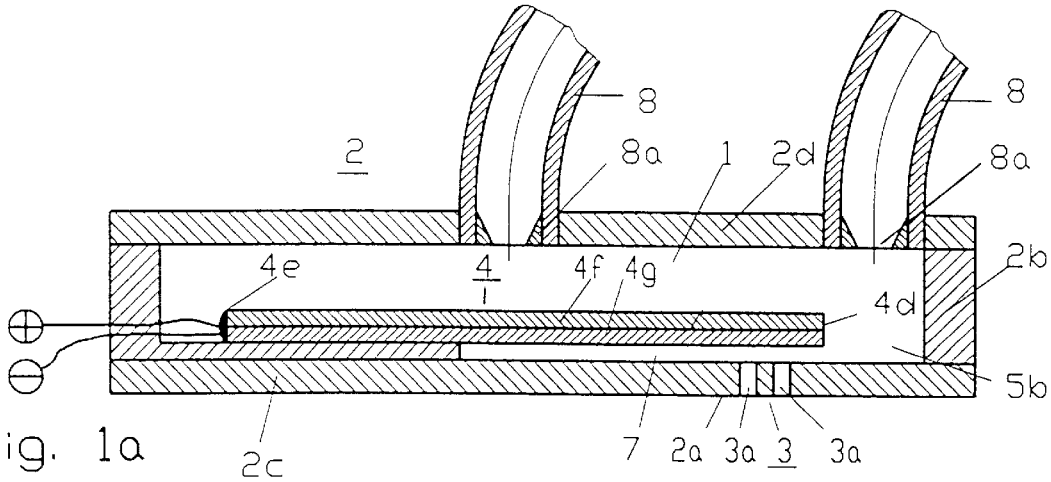
FIG. 1*a* shows a sectional view transverse to the direction of overhang of the piezoelectric flexural transducer of a droplet mist generator in accordance with a working form of the invention, whereby the piezoelectric flexural transducer is in its equilibrium position.
Figure 1B:
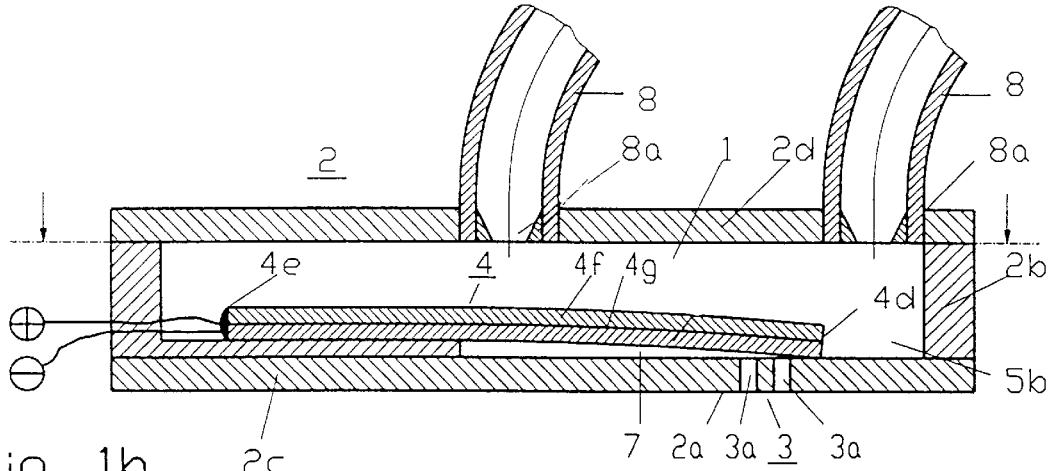
FIG. 1*b* is a sectional view of the droplet mist generator in accordance with FIG. 1*a*, whereby the piezoelectric flexural transducer is deflected by applied voltage.
Figure 1C:
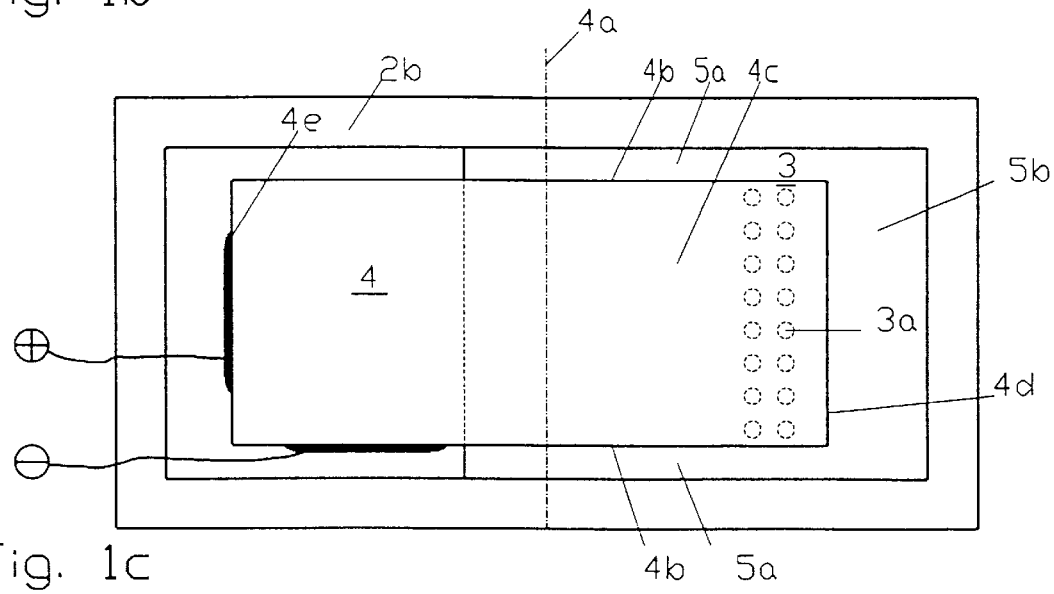
FIG. 1*c* is a sectional view of the droplet mist generator from FIG. 1*a* along the dotted line drawn in in FIG. 1*b*.

In FIGS. 1*a* to 1*c* one can see a construction of a droplet mist generator according to an advantageous working form of the invention. In a casing a pump chamber 1 is constructed that can be filled with fluids. The casing wall 2 is formed by a casing base part 2*c*, a casing middle part 2*b*, and a casing top part 2*d*. Inside the chamber 1 a piezoelectric flexural transducer 4, which can be deflected from its true path by the control system 6 (not shown in FIGS. 1*a*–1*c*), is attached so it overhangs. As can be seen in FIGS. 1*a* and 1*c*, the piezoelectric flexural transducer 4 is designed in a plate shape. Its end 4*e* is attached inside the casing. The opposite end 4*d* is free. The plate surface 4*c* is bounded by the edges 4*b* positioned on the sides in the direction of the overhang. The piezoelectric flexural transducer 4 is made of two layers 4*f*, 4*g* of piezoelectric ceramic. By applying voltage, the piezoelectric flexural transducer 4 can be bent around the axis 4*a* running transverse to the direction of overhang. With such bending, as can be seen in FIG. 1*b*, the free end 4*d* moves along a curve, which, by way of approximation, corresponds to a movement vertical to the direction of overhang and to the neutral axis 4*a*.

A part 2*a* of the casing wall 2 is positioned inside the overhang of the plate 4*c* on the casing wall 2 in the direction of the movement of the free end 4*d* of the piezoelectric flexural transducer 4 when it passes through its equilibrium position on the neighboring part of the casing wall. A nozzle area 3 with a majority of nozzles 3*a* is constructed in the part 2*a* of the casing wall 2. In the working example shown here the plate surface 4*c* and the part 2*a* of the casing wall 2 are even surfaces that run parallel to each other.

As can be seen in FIG. 1*a*, when the piezoelectric flexural transducer 4, is in equilibrium position, which occurs when the voltage is off, a gap 7 forms between the piezoelectric flexural transducer 4 and the part 2*a* of the casing wall 2 in which the nozzle area 3 is formed.

As one can see in FIG. 1*c*, between the edges 4*b* of the piezoelectric flexural transducer 4 and the casing wall 2 openings 5*a* are provided that are dimensioned large enough so that a movement of the piezoelectric flexural transducer 4 is not opposed by a flow resistance that is too strong, and when the piezoelectric flexural transducer 4 is moved back from the nozzle area 3 a sufficient current linkage can occur so that no air is drawn into the chamber 1 through the nozzles 3*a*. At the same time the openings 5*a* are sufficiently narrow so that when moving the piezoelectric flexural transducer 4 onto the nozzles 3*a* the fluid cannot go around the openings 5*a* quickly enough but instead is forced through the nozzles 3*a*.

Between the free end 4*d* of the piezoelectric flexural transducer and the opposite part of the casing wall lying in its extension an opening 5*b* is also constructed that is less than 5 times as wide—namely, about 4 times as wide—as the gap 7. In the working example seen in FIG. 1 the piezoelectric flexural transducer has measurements of 9×4×0.5 mm. The active, free length is 5.5 mm. The deflections that can be obtained on the free end are 25 μm at 50 V.

As one can see in FIG. 1, the chamber 1 on the side of the piezoelectric flexural transducer 4 turned away from the nozzle area 3 is built larger than it is on the other side of the gap 7. When deflecting the piezoelectric flexural transducer 4 from its true path, excessively large changes in pressure do not occur in this part of the chamber 1. The casing middle part 2*b* of the casing wall 2, which is positioned between the casing base part 2*c* and the casing top part 2*d* and which determines the height of the chamber, has a height of 675 μm in this example. Preferably, the casing components are made of silicon.

As is also clear from FIG. 1, the chamber 1 is connected through lines 8 to a fluid reserve (not shown). Choke sites 8*a* are constructed in the lines 8. The lines 8 are at a considerable distance from each other. They can therefore also be used for rinsing during the operation of the pump. In this connection it is advantageous that one of the two lines 8 is positioned at the end of the casing in the direction toward the free end 4*d* of the piezoelectric flexural transducer 4. With a corresponding orientation of the chamber 1 relative to gravity, the pump can be degassed by having the fluid flow through the line 8 positioned centrally, with the outlet through the line 8 positioned at the end. Gas bubbles that appear rise to the top and are rinsed out of the chamber 1. When the pump is in operation, the arrangement shown in FIG. 1, which has several lines 8 that connect the chamber 1 to the fluid reserve, is also advantageous. In the suction phase, evenly occurring drops in pressure occur by way of the chamber 1. The refill operation can thus be completed more quickly when two lines 8 exist. In the working example shown in FIG. 1 the line 8 has an inner diameter of 1 mm.

By applying voltage impulses to the piezoelectric flexural transducer 4 by using a control system 6, the piezoelectric flexural transducer is deflected from its true course. In so doing, fluid can be driven onto the nozzles and droplets ejected out the nozzles 3*a*. In the working form described the piezoelectric flexural transducer 4 can be moved to and from the nozzle area 3 by applying voltage my means of the control system 6. As can be seen in FIG. 1*b*, the piezoelectric flexural transducer 4 can be deflected so far by moving it from the nozzle area 3 that the free end 4*d* of the piezoelectric flexural transducer 4 hits against the part 2*a* of the casing wall in which the nozzle area 3 is constructed. As a result, the movement of the piezoelectric flexural transducer 4 is abruptly slowed, which leads to a particularly advantageous breaking off of the droplets. To improve the droplet ejection behavior the piezoelectric flexural transducer 4 can, nonetheless, first be moved a certain distance away from the nozzle area 3 so that a greater amount of fluid exists between the piezoelectric flexural transducer 4 and the nozzle area 3 before the piezoelectric flexural transducer 4 is moved onto the nozzle area 3.

Figure 17:
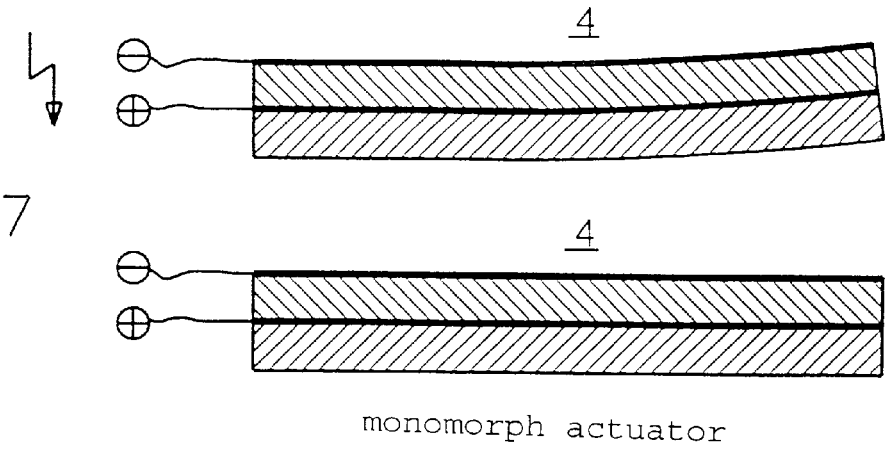
FIG. 17 is a principal representation of a monomorph piezoelectric flexural transducer.

As one can see in FIG. 1, the piezoelectric flexural element consists of two layers 4*f*, 4*g*. They are connected to each other so they cannot be slid back and forth. From FIG. 17 one can see more clearly the construction of the piezoelectric element used in this working form of the invention. It is a monomorph actuator. One of the layers is made of a piezoelectric ceramic layer; the other, of metal or another suitable material. Due to the piezoelectric effect, the piezoelectric ceramic layer is extended or compressed by applying voltage. When extending or compressing the layer with respect to the other layer, the layer construction is bent. This process can be reversed by discharging. This can take place either by applying the corresponding countervoltage or by a slow, independent discharging process.

Figure 16:
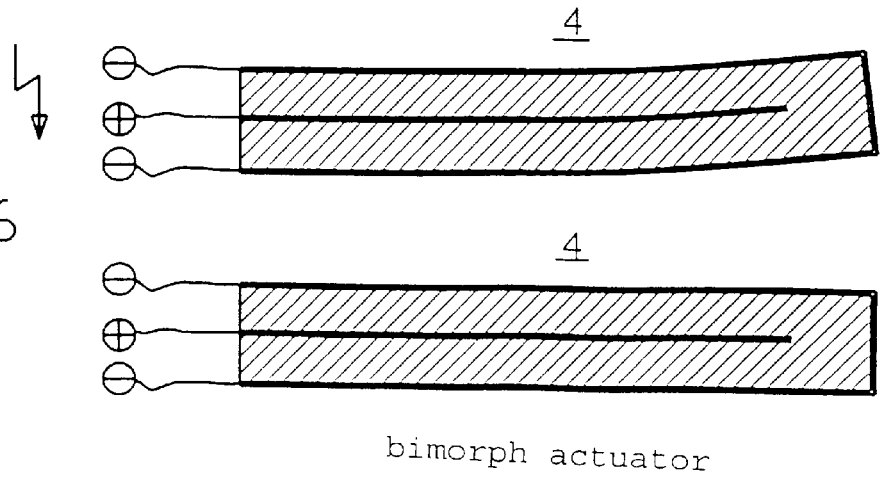
FIG. 16 is a principal representation of a bimorph piezoelectric flexural transducer.
Figure 18:
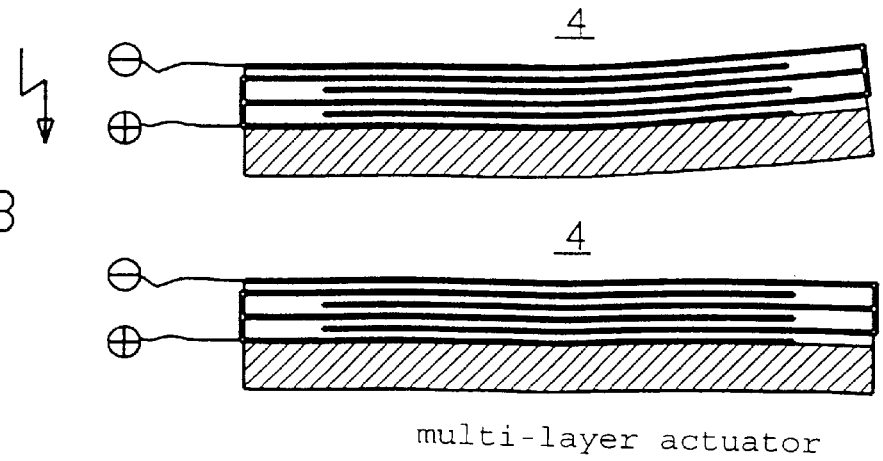
FIG. 18 is a principal representation of a multi-layer piezoelectric flexural transducer.

Other working forms of the piezoelectric flexural transducer according to the invention can be seen in FIG. 16 with a bimorph piezoelectric actuator and in FIG. 18 with a multi-layer piezoelectric flexural actuator. In the bimorph actuators two piezoelectric ceramic plates are provided with an electrode in the middle, as a result of which both layers are reverse polarized. By applying voltage the one layer is extended and the other compressed so that a larger bending occurs with equally applied differences in voltage. In a multi-layer piezoelectric flexural element the extensible or compressible layer is constructed from alternately very thin—e.g., 20 μm—piezoelectric layers and electrodes stacked on each other, which are fused with each other or firmly glued together. In this case the electrodes are interlocked as in a film capacitor—i.e., the inverse polarized electrodes alternate. As a result the same electrical field strength is produced in the piezoelectric ceramic layers with low voltage and thus the same extent of the piezoelectric effect is produced. The operating voltage falls considerably in such a case, e.g., from several 100 V to about 30 to 60 V.

As can be seen in FIG. 1, at least two nozzles 3*a* exist, which form the nozzle area 3.

Figure 13A:
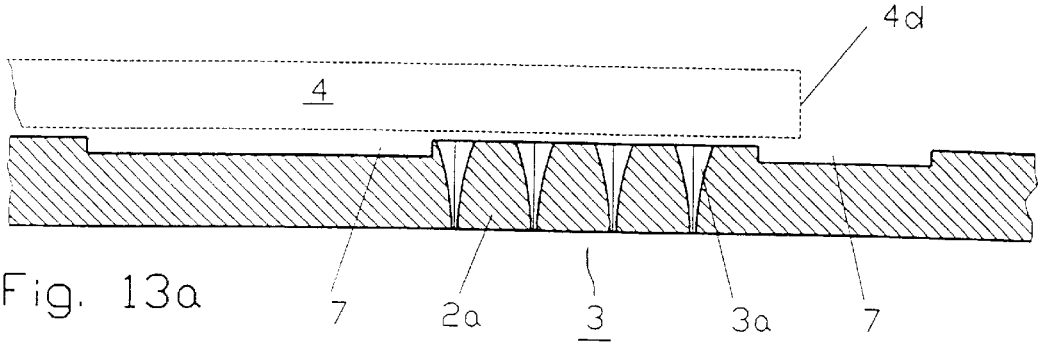
FIG. 13*a* is a sectional view of a nozzle area designed according to the invention.
Figure 13B:
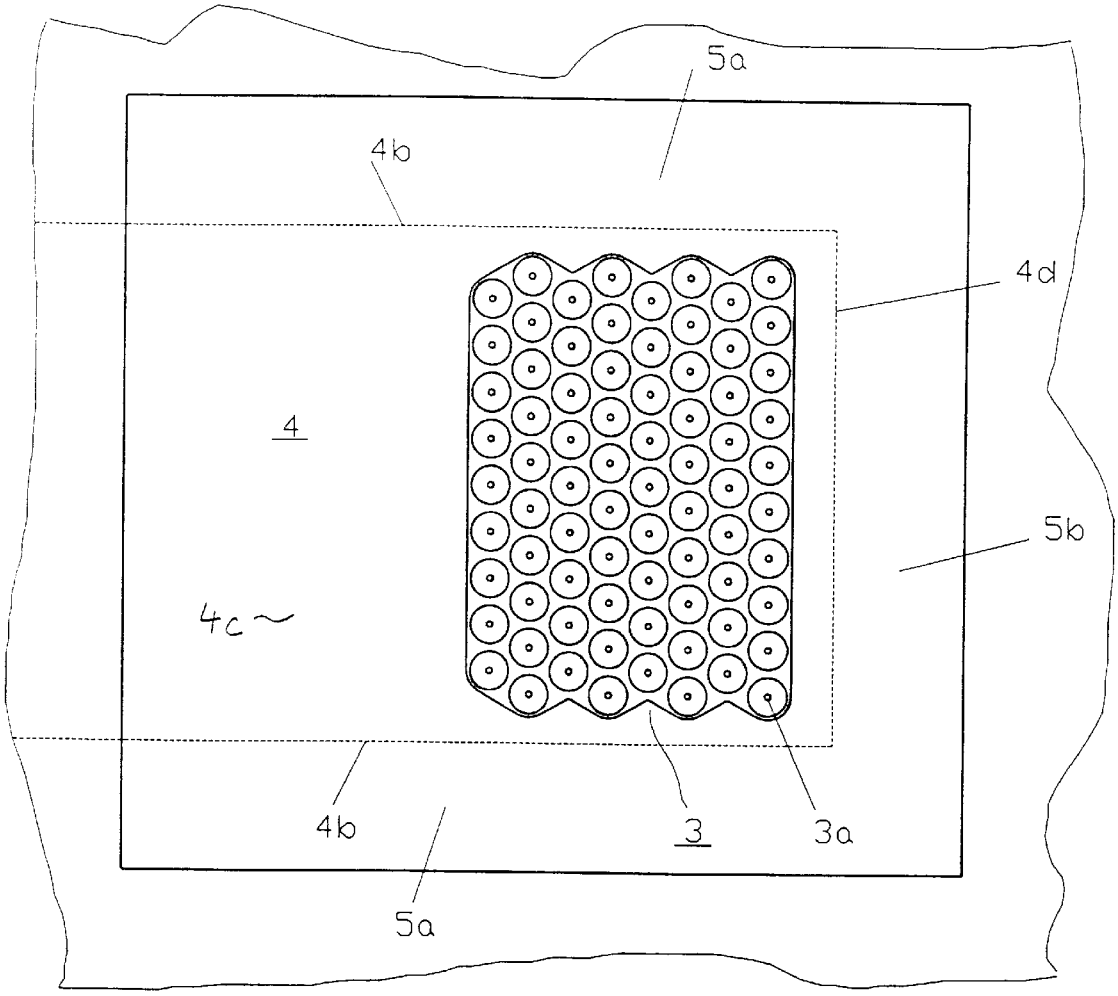
FIG. 13*b* is a top view onto the nozzle area designed according to the invention and represented in FIG. 13*a*.

In the FIGS. 13*a* and 13*b* one can see how the nozzles 3*a* and the nozzle area 3 are formed in another advantageous working form. As is clear in FIG. 13*a*, the nozzles are designed in such a way that they taper from the chamber inner side to the chamber outer side. The part 2*a* of the casing wall in which the nozzles 3*a* of the nozzle area are constructed has a 35-μm thick teflon layer on the outside (not shown in the diagram).

In FIG. 13*b* the arrangement of the nozzles is shown in FIG. 13*a* in a top view. The nozzles are positioned regularly with an equal distance between neighboring nozzles. In each case the series of nozzles is positioned so the nozzles are staggered with respect to a neighboring series of nozzles. This allows for the possibility of packing the nozzles as closely as possible while taking into consideration technical manufacturing specifications.

Figure 2A:
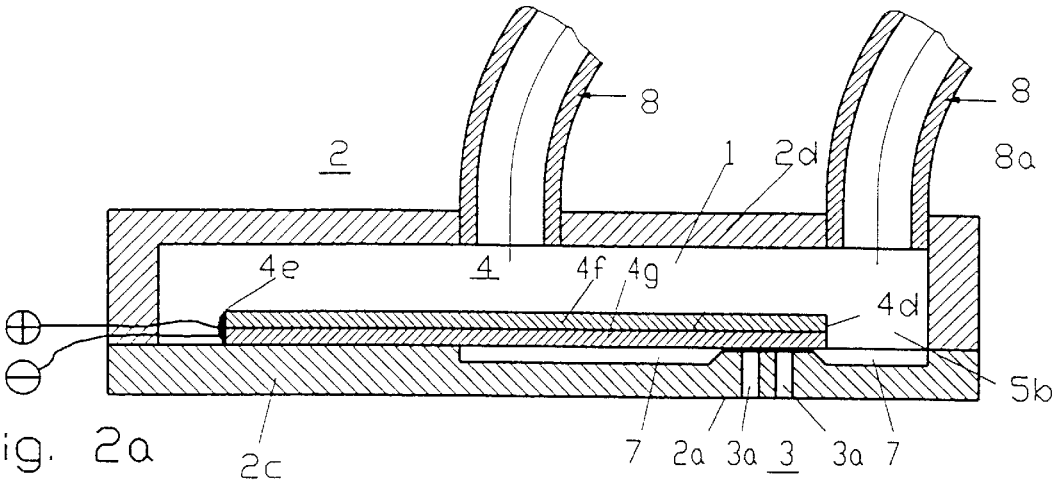
FIG. 2*a* is a sectional view of a droplet mist generator according to another model of the invention in which the part of the casing wall in which the nozzle area is constructed projects into the chamber, whereby the piezoelectric flexural transducer is in its equilibrium position.
Figure 2B:
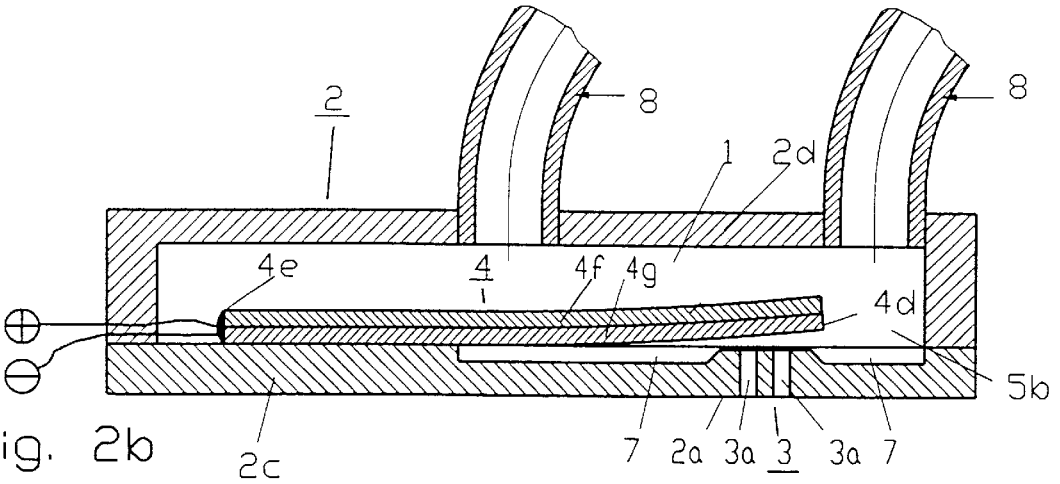
FIG. 2*b* is a sectional view of the droplet mist generator according to FIG. 2*a*, whereby the piezoelectric flexural transducer is deflected by applied voltage.

Another advantageous working form of the droplet mist generator according to the invention can be seen in FIGS. 2*a* and 2*b*. The part 2*a* of the casing wall 2 in which the nozzle area 3 is formed projects into the chamber 1. The piezoelectric flexural transducer 4 lies in equilibrium position on the part 2*a* of the casing wall 2 in which the nozzle area 3 is formed. In the area neighboring on the nozzle area 3 there is a gap 7 between the piezoelectric flexural transducer 4 and the casing wall 2. While operating the droplet mist generator the piezoelectric flexural transducer 4 is first moved from its equilibrium position from the nozzle area and then moved back onto the nozzle area 3 by either applying a reverse polarized voltage or mechanical restoring forces.

Figure 3:
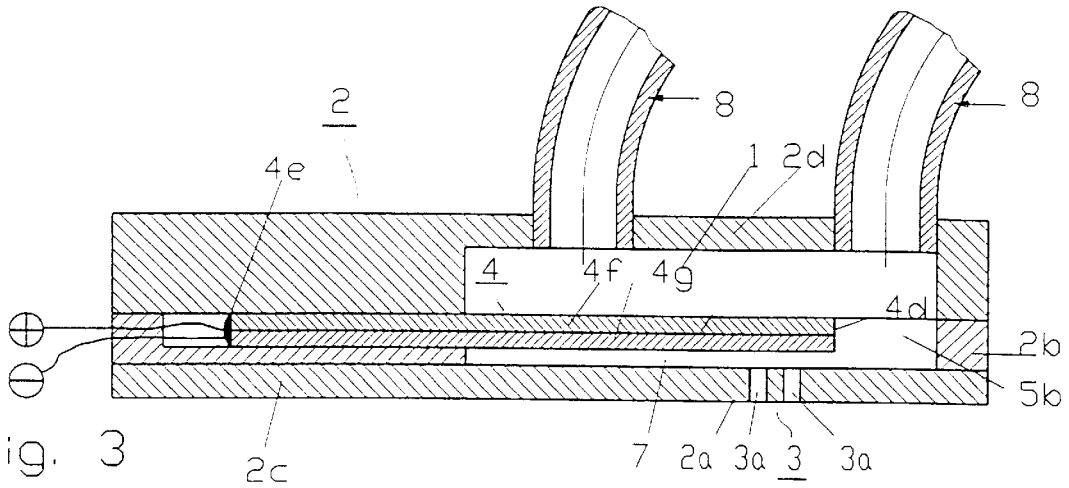
FIGS. 3, 4, and 5 are all sectional views of a droplet mist generator in accordance with another working form of the model.
Figure 15:
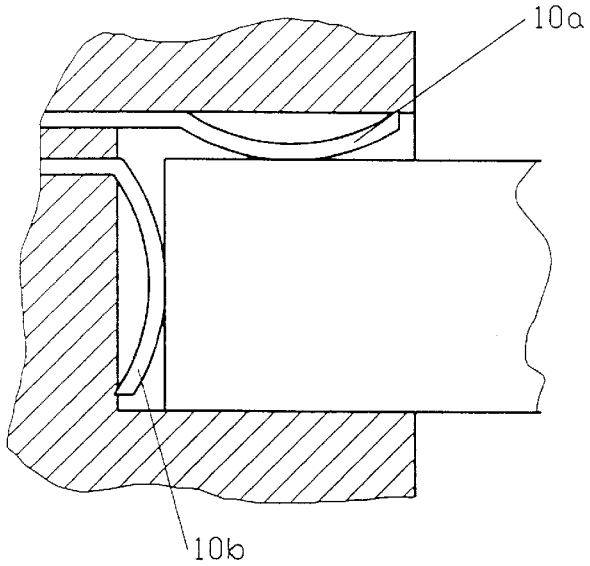
FIG. 15 is a representation of an example of the contact of a piezoelectric flexural transducer in a droplet mist generator designed according to the invention.

In FIG. 3 another working form of the droplet mist generator according to the invention can be seen. The casing is made of the three components 2*d*, 2*c*, and 2*e*, which form the casing wall 2. In this connection the casing base part 2*c* is designed as a plate. The piezoelectric flexural transducer 4 is squeezed in between the casing parts 2*c* and 2*d* and anchored in this way. In FIG. 15 one can see the construction of the contact of the piezoelectric flexural transducer with the contact springs 10*a*, 10*b* in this working example.

Figure 4:
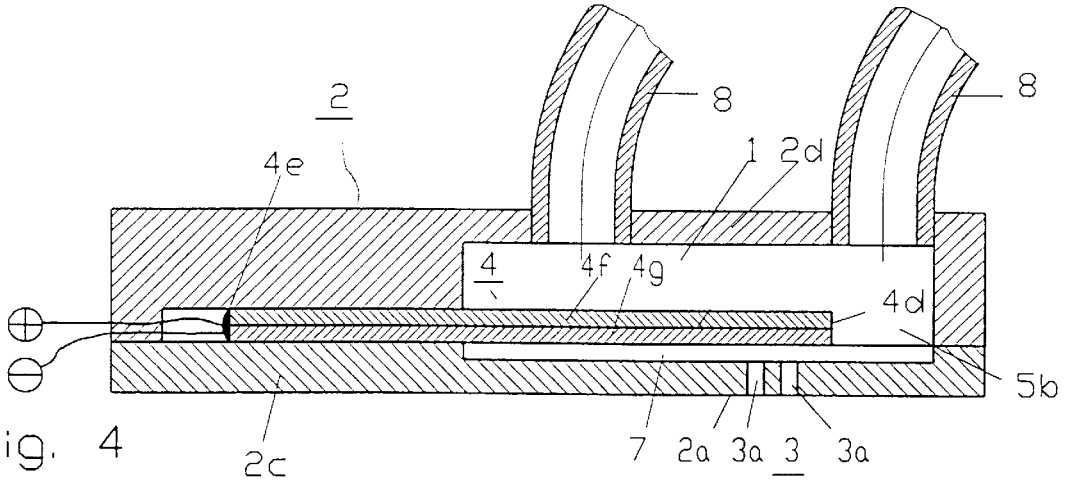

Another working form of a droplet mist generator according to the invention can be seen in FIG. 4. The casing is made of only two casing parts, whereby the piezoelectric flexural transducer 4 is firmly squeezed between the casing base part 2*c* and the casing top part 2*d* lying opposite it.

Figure 5:
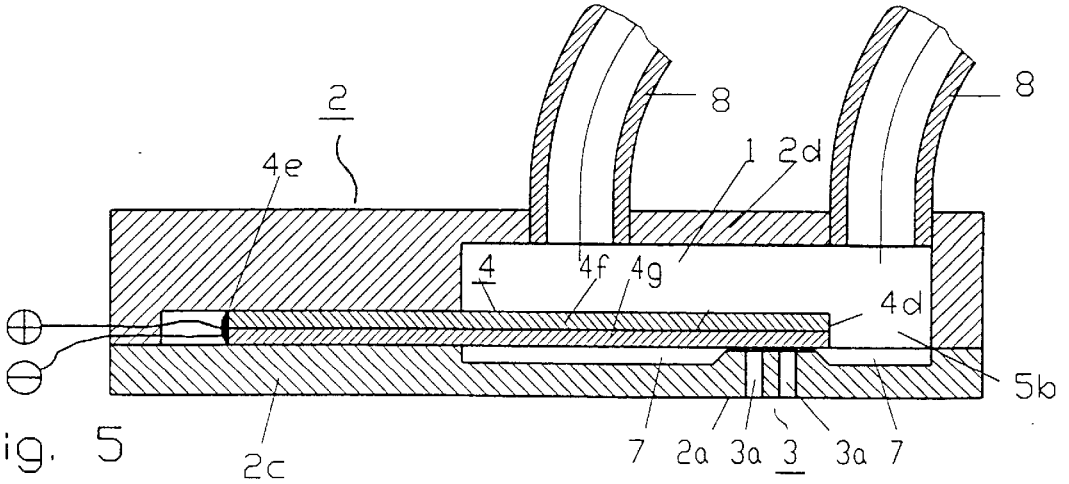

In FIG. 5 another working form of a droplet mist generator according to the invention can be seen. As can be seen in the working form in FIG. 2, the part 2*a* of the casing wall 2 is formed so it projects into the chamber 1. In this case the piezoelectric flexural element 4, however, does not rest on the part 2*a* of the casing wall 2 in its equilibrium position; rather, there is a gap between the piezoelectric flexural transducer 4 and the part 2*a* of the casing wall 2. The piezoelectric flexural element can therefore be bent directly onto the nozzle area so that droplets are ejected by using the control system 6. If the piezoelectric flexural element 4 in this working form is then moved away from the nozzle area 3 by using the control system 6, advantages occur compared to the working form represented in FIG. 2. The surfaces of the piezoelectric flexural transducer 4 lying across from each other and the part 2*a* of the casing wall 2 are already moistened with fluid when the piezoelectric flexural transducer 4 is moved away from the part 2*a* of the casing wall, as a result of which fluid is drawn more quickly into the larger-growing gap and a higher spray frequency is obtained.

Figure 6:
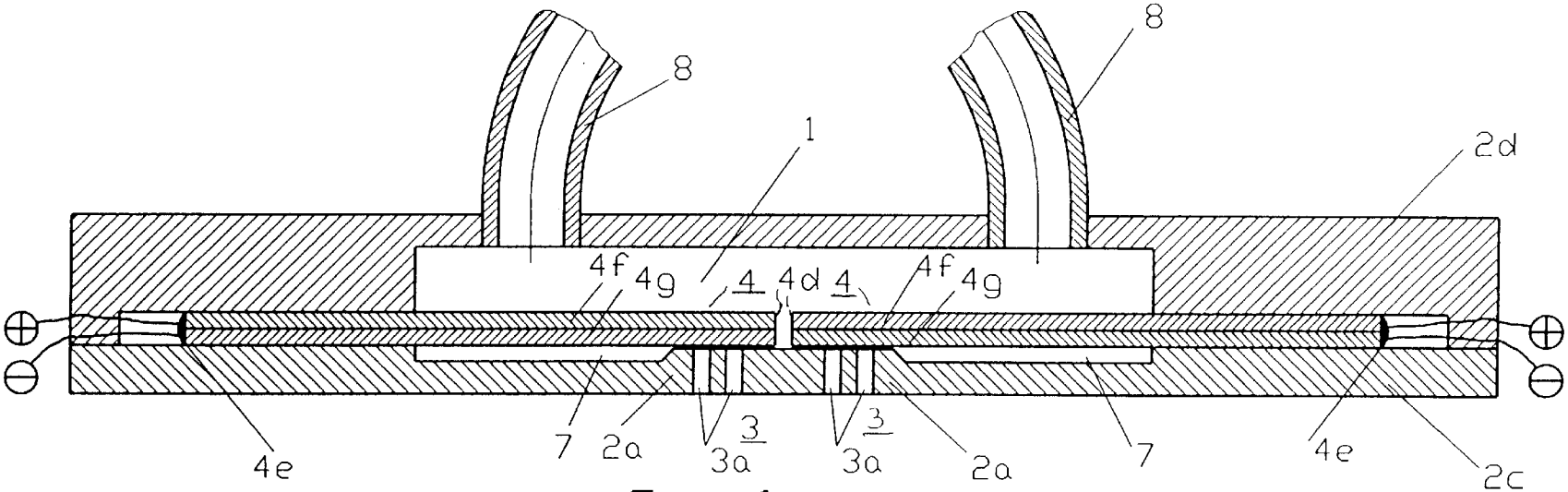
FIG. 6 is a sectional view of a droplet mist generator in accordance with yet another working form of the model in which two arrangements from a piezoelectric flexural transducer and a nozzle area face each other in mirror-inverted fashion with respect to the free end of the piezoelectric flexural transducer.

Still another advantageous working form of a droplet mist generator according to the invention can be seen in FIG. 6. Two piezoelectric flexural transducers 4 and two nozzle areas 3 lie across from each other in mirror-inverted fashion.

Figure 7:
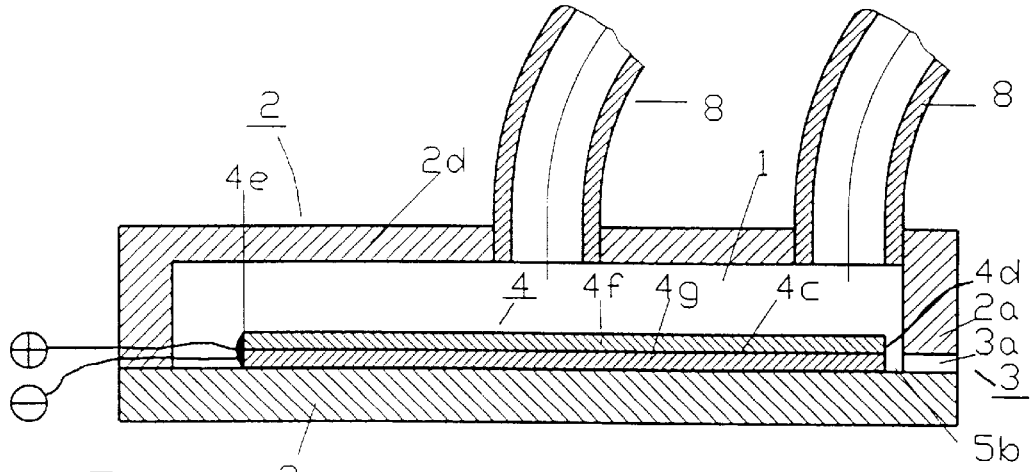
FIG. 7 is a sectional view of a droplet mist generator in accordance with yet another working form of the model in which the nozzle area is positioned opposite its free end lying in the extension of the piezoelectric flexural transducer.

Another advantageous working form of a droplet mist generator according to the invention can be seen in FIG. 7. The nozzle area 3 in this case is formed in the extension of the piezoelectric flexural transducer 4 across from the free end 4*d* of the piezoelectric flexural transducer in the casing wall. In the working form that can be seen in FIG. 7 the entire length of the piezoelectric flexural transducer 4 lies against the casing wall 2, and the nozzle area 3 is formed in one of the corners of the casing wall 2 lying across from one of the ends of the piezoelectric flexural transducer 4. In this case the nozzle area is formed on the boundary surface between the two casing components—the casing base part 2*c* and the casing top part 2*d*.

Figure 8:
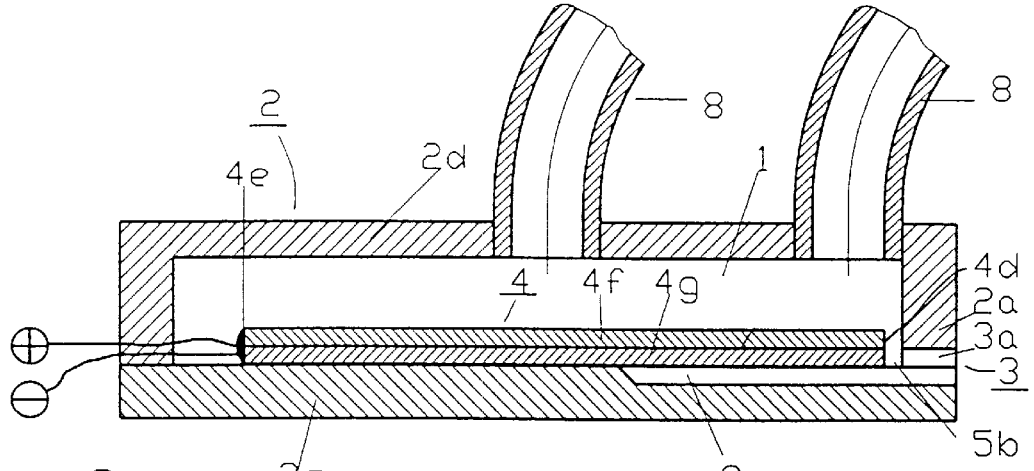
FIGS. 8, 9, 10, 11, 12 are all sectional views of a droplet mist generator in accordance with yet another working form of the model in which the nozzle area is positioned opposite the free end lying in the extension of the piezoelectric flexural transducer.
Figure 9:
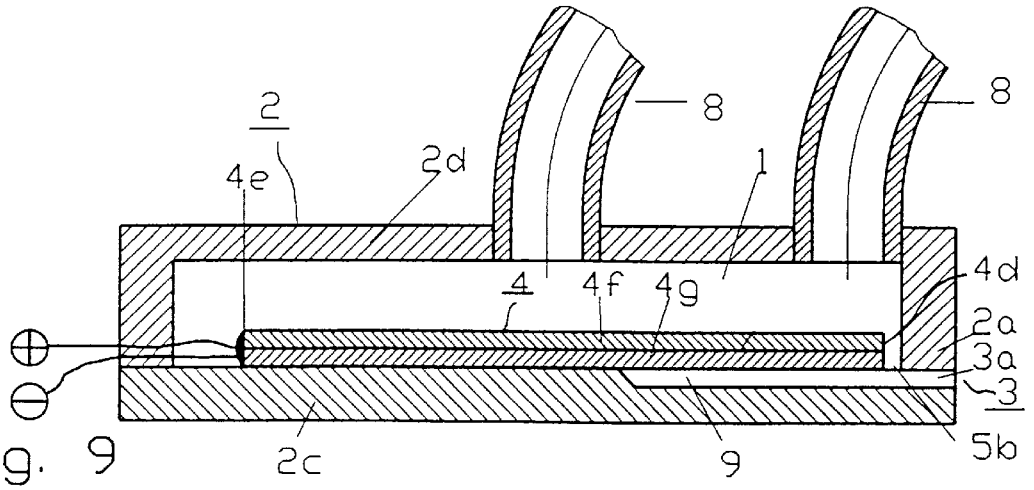

In two other advantageous working forms, which can be seen in FIGS. 8 and 9, the entire length of the piezoelectric flexural transducer 4 does not lie against the casing wall 2 in its equilibrium position; its attached end 4*e* is anchored onto the casing base part 2*c* of the casing wall 2, and in the area of the free end 4*d* of the piezoelectric flexural transducer 4 there are recesses 9 provided in the casing base part 2*c* that are designed as grooves. With the grooves the space of the chamber 1 is expanded on the side of the piezoelectric flexural transducer turned away from the lines 8, through which the chamber 1 is connected to the fluid reserve. The recesses 9 in the casing base part 2*c* essentially extend in the direction of the overhang of the piezoelectric flexural transducer 4. In the corner of the chamber 1 formed in the place of the casing wall 2 in which the casing base part 2*c* and the casing top part 2*d* meet each other, the recesses 9 change over into the nozzles 3*a* of the nozzle area 3. In this corner the recesses 9 form the nozzles 3*a* in the casing wall alone or together with other partial recesses in the casing top part 2*d*, as one can see in FIGS. 8 and 9.

Figure 10:
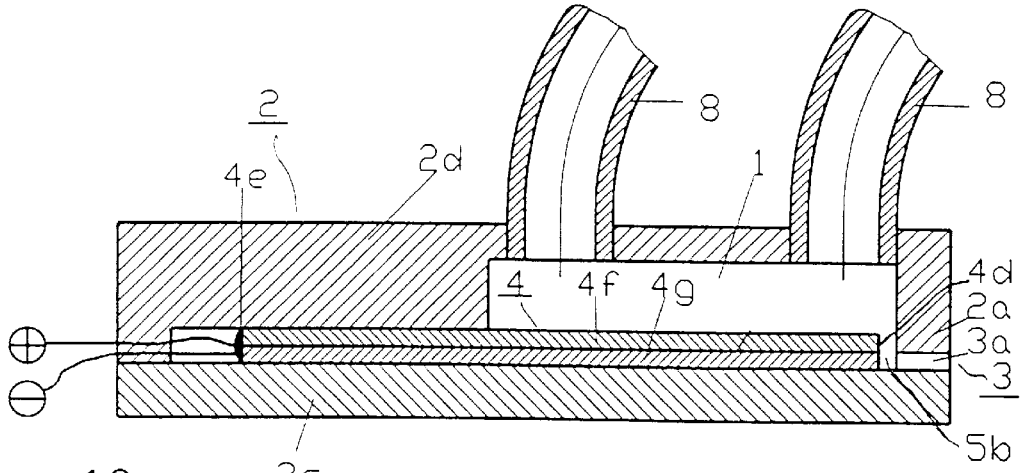
Figure 11:
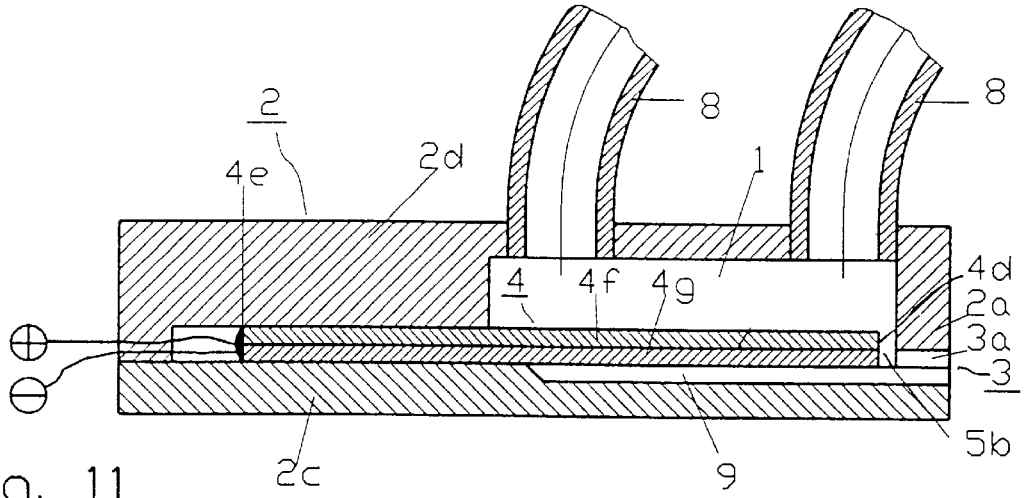
Figure 12:
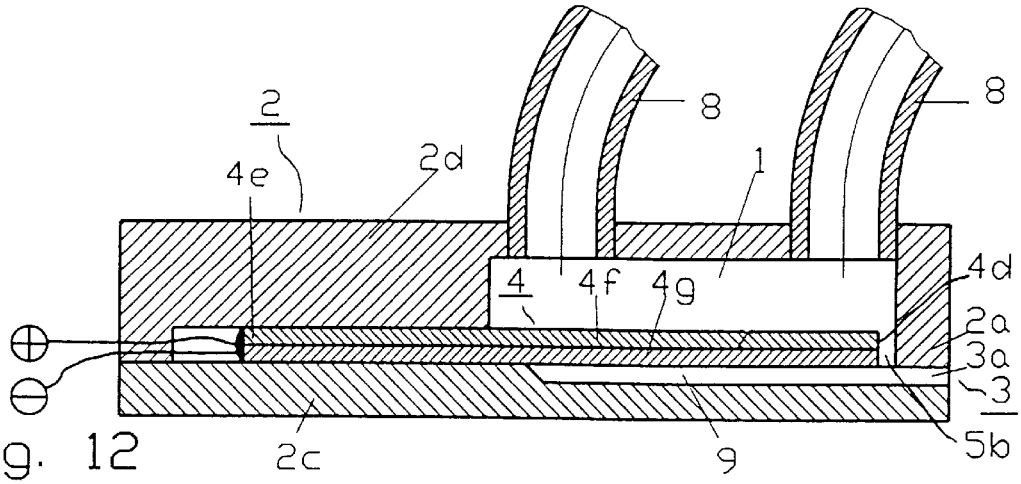

In FIGS. 10, 11, and 12 working forms can be seen in which the pump chamber 1 and the nozzles 3*a* are essentially designed as in the working forms of FIGS. 7, 8, and 9. But the piezoelectric flexural transducer 4 is not attached to only one casing component part 2*c* (as in FIGS. 7, 8, and 9), the piezoelectric flexural transducer 4 is attached to the casing between the casing base part 2*c* and the casing top part 2*d*.

Figure 14:
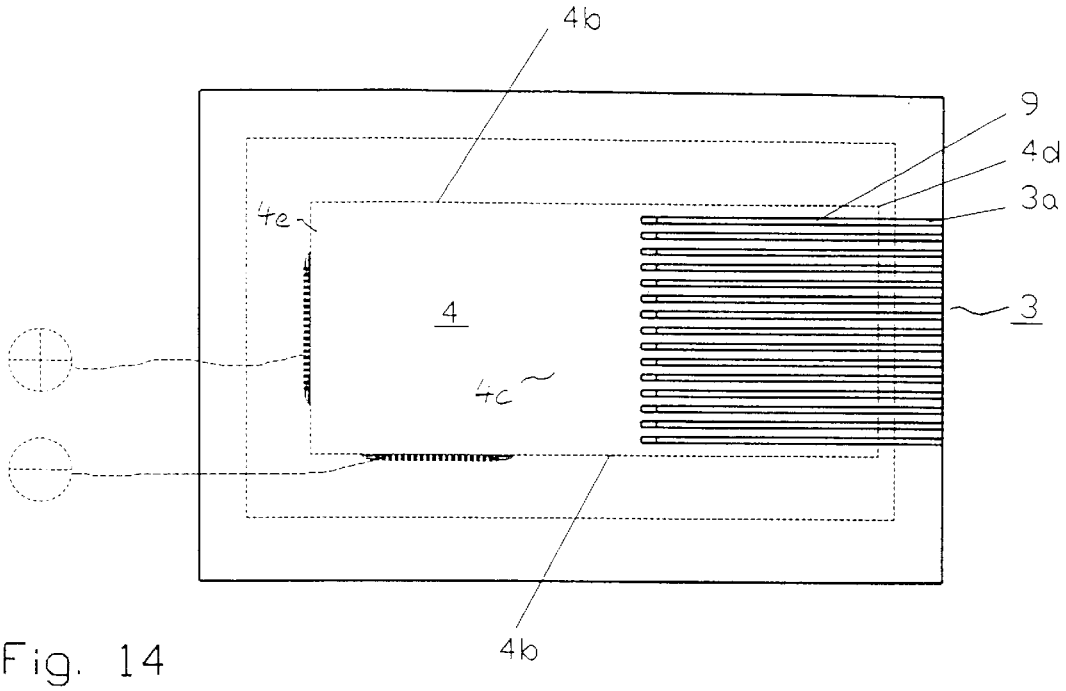
FIG. 14 is a view of a droplet mist generator from FIG. 9 in a top view in the direction vertical to the plate surface of the piezoelectric flexural element.

In FIG. 14 in a top view, recesses 9 provided are positioned as in the working forms of the invention in FIGS. 8, 9, 11, and 12.

Figure 19:
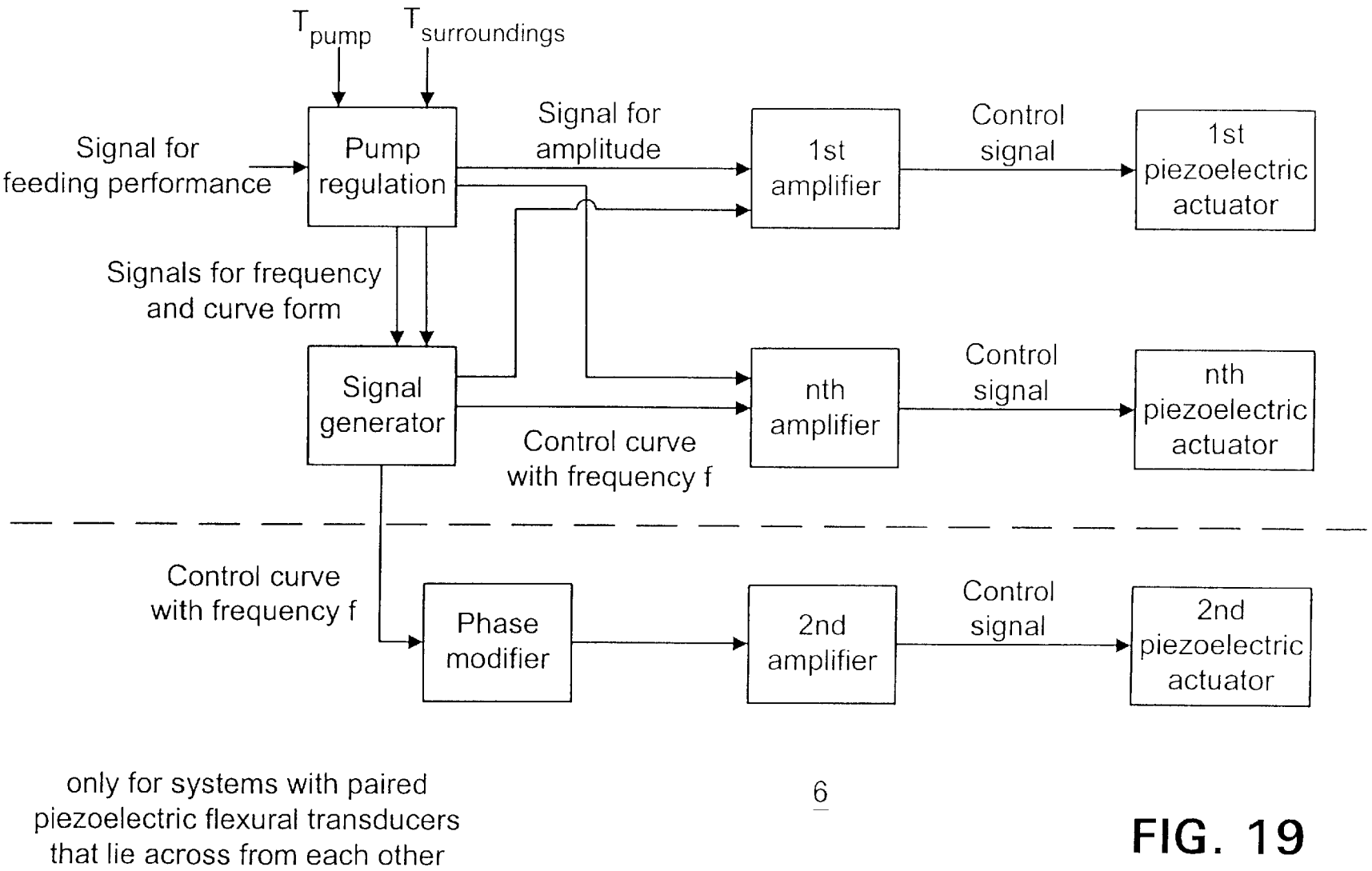
FIG. 19 is a principal representation of a control system used in accordance with a working form of the invention.

An example of a control system 6 in a droplet mist generator according to the invention can be seen in FIG. 19. As many suitable known control systems as desired can be used for the purpose of the present invention.

In an advantageous working form of the invention a frequency generator is connected at a later point to a MOS-FET circuit, which interrupts the charging process and thus the deflection process of the piezoelectric flexural element, which occurs through a power supply and a resistance, and discharges the piezoelectric ceramic. In so doing the sudden movement of the piezoelectric flexural transducer is achieved. In the charging phase, i.e., for example when moving the piezoelectric flexural transducer 4 away from the nozzle area 3, the piezoelectric flexural transducer 4 is charged with a resistance of 270 in about 150 microseconds to 95% of the power supply voltage. With the rising side of the square wave signal of the generator at the gate of the MOS-FET the discharging occurs through the inner resistance of the FETs. This lasts about 100 nanoseconds. Due to the mechanical inertia of the actuator, the discharging phase must be extended until the piezoelectric flexural transducer 4 slowed by the fluid completes the movement and the droplet is ejected. This is achieved with a standard frequency of 5,000 to 6,000 Hz through a pulse-duty factor of 25%, i.e., in a time of 40 to 50 microseconds.

What is claimed is:

1. Droplet mist generator for producing a droplet mist comprising:

a pump chamber connected to a fluid reservoir and bounded by a casing wall;

a nozzle area constructed in the casing wall, said nozzle area having a plurality of nozzles;

a plate-shaped, piezoelectric flexural transducer positioned in the pump chamber and attached so that it forms an overhang and is bendable around a transverse axis that runs transversely to the direction of the overhang for alternatingly carrying out a displacement stroke, wherein fluid is driven towards the nozzles of the nozzle area and fluid droplets produced are ejected from the nozzles in the form of a droplet mist and a return stroke, whereby the piezoelectric flexural transducer is common to the plurality of the nozzles of the nozzle area;

side openings formed between lateral edges of the piezoelectric flexural transducer and a portion of the casing wall lying opposite to said lateral edges, and wherein a connection between the fluid reservoir and the pump chamber empties into the pump chamber at the side of the piezoelectric flexural transducer turned away from the nozzle area, and;

a control system by which the piezoelectric flexural transducer is controlled by voltage pulses for the displacement stroke, which occurs more quickly than the return stroke in which the fluid flows back through the side openings.

2. Droplet mist generator according to claim 1, whereby the pump chamber is connected to the fluid reservoir through several lines.

3. Droplet mist generator according to claim 1, whereby the connection between the pump chamber and the fluid reservoir has a choke site.

4. Droplet mist generator according to claim 1, whereby the nozzles are designed to taper in the direction away from the pump chamber.

5. Droplet mist generator according to claim 1, whereby that part of the casing wall constructed with the nozzle area is covered on outside with Teflon.

6. Droplet mist generator according to claim 1, whereby the piezoelectric flexural transducer is a multi-layer piezoelectric ceramic transducer with an additional passive piezoelectric ceramic layer.

7. Droplet mist generator according to claim 1, whereby the nozzle area is constructed in a first part of the casing wall that is located under the overhang of the piezoelectric flexural transducer in the direction in which a free end of the piezoelectric flexural transducer can be moved, and a frontal gap is constructed between the free end of the piezoelectric flexural transducer and a second part of the casing wall lying opposite to said free end.

8. Droplet mist generator according to claim 7, whereby in an equilibrium position of the piezoelectric flexural transducer, which occurs when the voltage is not on, an equilibrium gap is formed between the piezoelectric flexural transducer and that part of the casing wall where the nozzle area is constructed, and by applying the voltage, the piezoelectric flexural transducer can be moved to or from the nozzle area.

9. Droplet mist generator according to claim 8, whereby the frontal gap constructed between the free end of the piezoelectric flexural transducer and the second part of the casing wall lying opposite to said free end is not more than five times as large as the equilibrium gap.

10. Droplet mist generator according to claim 9, whereby in the equilibrium position of the piezoelectric flexural transducer, which occurs when the voltage is off, the piezoelectric flexural transducer contacts that part of the casing wall where the nozzle area is constructed, and the piezoelectric flexural transducer can be moved away from the nozzle area by applying voltage.

11. Droplet mist generator according to claim 7, whereby that part of the casing wall where the nozzle area is constructed projects into the pump chamber.

12. Droplet mist generator according to claim 7, whereby an arrangement that is essentially mirror-inverted to the piezoelectric flexural transducer and the nozzle area and that has a second piezoelectric flexural transducer and a second nozzle area is positioned opposite to the free end of the piezoelectric flexural transducer, and the control system is constructed so as to control the piezoelectric flexural transducer and the second piezoelectric flexural transducer with varying pulse frequencies, pulse lengths, and/or pulse phases.

13. Droplet mist generator according to claim 1, whereby the nozzle area is positioned in that part of the casing wall opposite to a free end of the piezoelectric flexural transducer.

14. Droplet mist generator according to claim 1, wherein the droplet mist generator is coupled to a burner as a component of the burner, whereby the fluid reservoir is a fluid fuel reservoir, and the nozzles of the nozzle area serve as burner nozzles and have a smallest diameter of at least 10 $\mu$m and at most 100 $\mu$m.

15. Droplet mist generator according to claim 14, whereby a distance between mid-points of neighboring nozzles of the nozzle area serving as the burner nozzle is at least 50 $\mu$m and at most 2,000 $\mu$m.

16. Droplet mist generator according to claim 1, which has at least 50 said nozzles.

* * * * *